US009222334B2

(12) United States Patent
Erkol et al.

(10) Patent No.: US 9,222,334 B2
(45) Date of Patent: Dec. 29, 2015

(54) VALVE SYSTEM FOR DOWNHOLE TOOL STRING

(75) Inventors: Zafer Erkol, Sugar Land, TX (US); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 403 days.

(21) Appl. No.: 13/163,013

(22) Filed: Jun. 17, 2011

(65) Prior Publication Data

US 2012/0318527 A1 Dec. 20, 2012

(51) Int. Cl.
*E21B 34/06* (2006.01)
*E21B 34/00* (2006.01)

(52) U.S. Cl.
CPC ..... *E21B 34/06* (2013.01); *E21B 2034/002* (2013.01)

(58) Field of Classification Search
USPC ..... 166/334.2, 334.4, 332.7, 332.3, 386, 166/373; 137/614.17, 613, 614.2
See application file for complete search history.

(56) References Cited

U.S. PATENT DOCUMENTS 3,954,288 A * 5/1976 Smith ..... 285/93
4,220,176 A * 9/1980 Russell ..... 137/496
4,230,154 A * 10/1980 Kalbfleish ..... 137/614.17
4,596,294 A * 6/1986 Russell ..... 175/74
4,928,725 A * 5/1990 Graves ..... 137/269.5
5,236,009 A 8/1993 Ackroyd
5,287,877 A 2/1994 Ackroyd
5,341,987 A 8/1994 Ackroyd
5,564,467 A 10/1996 Ackroyd
5,855,224 A 1/1999 Lin et al.
6,021,805 A 2/2000 Horne et al.
6,050,293 A 4/2000 Lin et al.
6,192,933 B1 2/2001 Engelmann
6,325,090 B1 12/2001 Horne et al.
6,435,771 B1 * 8/2002 Baugh ..... 405/158
6,505,813 B1 1/2003 Horne et al.
6,550,541 B2 * 4/2003 Patel ..... 166/386
6,648,013 B1 11/2003 Ray
2008/0135235 A1 * 6/2008 McCalvin ..... 166/250.01

* cited by examiner

*Primary Examiner* — David Andrews
(74) *Attorney, Agent, or Firm* — Michael L. Flynn; Timothy Curington; Robin Nava

(57) ABSTRACT

A technique facilitates the delivery and testing of a tool string assembly downhole. The technique employs at least one rotatable element valve in the tool string at a location which enables the rotatable element valve to be used for selectively blocking or allowing fluid flow along an interior passage of the tool string. A one-way valve, such as a flapper valve, dart valve, or spring loaded ball valve, is deployed within a rotatable element of each rotatable element valve to combine flow control functions, thus enabling a shorter tool string section. The at least one rotatable element valve also may be designed to facilitate pressure testing of the tool string.

18 Claims, 5 Drawing Sheets

VALVE SYSTEM FOR DOWNHOLE TOOL STRING

BACKGROUND

The statements in this section merely provide background information related to the present disclosure and may not constitute prior art. In many well applications, a tool string is delivered downhole to perform a desired function with respect to the well. Oil and gas well pressure deployments in coiled tubing, slick line, and wireline operations have become common, and pressure control in the wellbore can be important with respect to QHSE (quality, health, safety and environment) considerations.

The tool string may be delivered downhole in multiple sections and stages, and ball valves are sometimes employed to facilitate the multi-stage deployment. However, the ball valves used in tool strings are limited in that they do not facilitate desired pressure testing, rendering such ball valve systems susceptible to QHSE issues. Additionally, some tool string applications have attempted to achieve greater control over undesirable flow by adding check valves to the tool string. However, the addition of such valves creates an undesirably longer tool string and increases the cost associated with the operation.

SUMMARY

In general, a system and method is described herein for facilitating the delivery and testing of a tool string assembly downhole and for enabling safe deployment and un-deployment of downhole tools. The technique employs at least one rotatable element valve, e.g. a ball valve, in the tool string at a location which enables the rotatable element valve to be used for selectively blocking or allowing bidirectional fluid flow along an interior passage of the tool string. A one-way valve, e.g. a flapper valve, is deployed within a rotatable element of each rotatable element valve to combine flow control functions, thus enabling a shorter tool string section. The at least one rotatable element valve also may be designed to facilitate pressure testing of the tool string.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
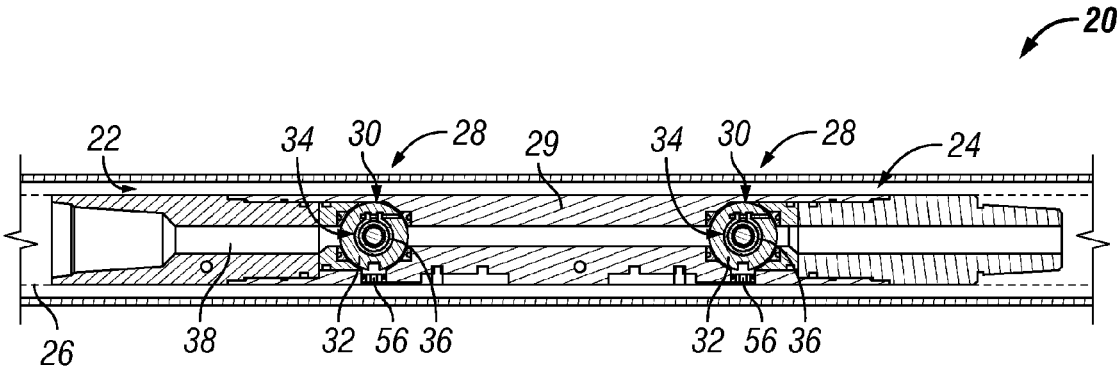
FIG. 1 is a cross-sectional view of a tool string assembly forming part of a tool string deployed in a wellbore and having a plurality of rotatable element valve assemblies, e.g. ball valve assemblies.

In the following description, numerous details are set forth to provide an understanding of the present invention. However, it will be understood by those of ordinary skill in the art that the present invention may be practiced without these details and that numerous variations or modifications from the described embodiments may be possible.

The description herein generally relates to a system and method which facilitate pressure deployments of tools downhole. According to one embodiment, a method is provided which facilitates delivery of a tool assembly downhole by utilizing at least one rotatable element valve assembly, e.g. at least one ball valve assembly, comprising a rotatable element valve with an internal one-way valve. In some applications, a plurality of sequential valve assemblies may be employed with each valve assembly comprising a ball valve and a one-way valve, e.g. flapper valve, located within the ball valve. This combination of functionality avoids the need to construct a longer tool string. Additionally, the embodiments described herein may be employed to facilitate oil and gas well pressure deployments on, for example, coiled tubing, slick line, and wireline in a manner which improves the quality, health, safety and environmental considerations.

In general, the embodiments may be used to improve the operational capability of rotatable element valves by providing rotatable element type valves which have an additional internal check valve. The structure is able to eliminate a variety of undesirable pressure related issues. With at least some of the embodiments, the ability to test the downhole tool assembly before and during deployment or un-deployment is improved. The internal one-way valve, e.g. flapper type valve, improves the ability to pressure test the system and to reduce the potential for human error.

According to one specific example, a downhole tool assembly comprises a pair of ball valve assemblies which each include a ball type valve having a check valve flapper installed within a ball of the ball valve. The assembly further comprises pressure test and bleed ports above, below and/or between the ball valves. This configuration enables the ball valve assemblies and the overall downhole tool assembly to be arranged in a variety of different positions or configurations, such as a flow downward position, a flow fully blocked position, and a reverse circulation position. The arrangement allows each position to be pressure tested.

The various embodiments also may utilize other features to facilitate deployment and/or use of the downhole tool assembly. For example, each rotatable element valve may be lockable in a variety of positions with each position marked and visible at an exterior location. The valve assemblies also may comprise ports for injecting lubricant, e.g. grease, and/or or injecting sealing material in the event of a failed valve during, for example, un-deployment. The rotatable element valves and the internal one-way valves also may be designed to enable full bore flow capability. In some embodiments, dart type valves may be installed within the rotatable element, e.g. ball. Additionally, flow control or pressure control valves may be incorporated into the valve assemblies.

Referring generally to FIG. 1, an embodiment of a well system 20 is illustrated as deployed in a wellbore 22. The well system 20 comprises a downhole tool assembly 24 which is part of an overall tool string 26. In some applications, the tool string 26 may comprise a coil tubing tool string. The downhole tool assembly 24 comprises at least one rotatable element valve assembly 28, e.g. at least one ball valve assembly. A pair of sequential rotatable element valve assemblies 28 is illustrated in the example of FIG. 1. Each rotatable element valve assembly 28 may be mounted in a tool assembly housing or sub 29 and comprises a rotatable element valve 30 having a rotatable element 32. Additionally, each rotatable element valve assembly 28 comprises a one-way valve 34 which may be in the form of a dart valve, a spring-loaded ball, a flapper valve having a flapper 36, or another type of suitable one-way valve. By way of example, each one-way valve 34 may be located within an interior of the corresponding rotatable element 32. The rotatable element valves 30 are illustrated as ball valves having rotatable balls, but the rotatable element 32 also may comprise a rotatable plug, e.g. a cylindrical or conical plug, a rotatable ball which rotates about support trunnions, or other suitable rotatable elements. For purposes of explanation, the rotatable element valve 30 and the rotatable element 32 are referred to as ball valves 30 and balls 32 in the description below. However, the ball valves 30 and balls 32 should be considered representative of the other types of rotatable element valves.

Figure 2:
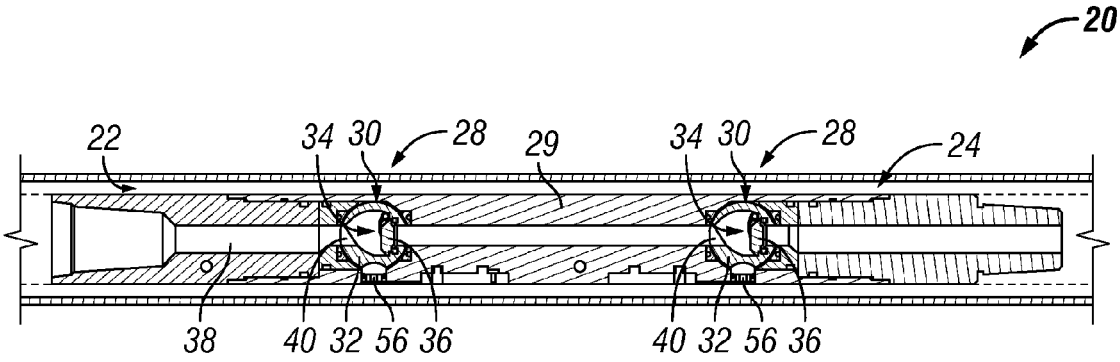
FIG. 2 is a cross-sectional view similar to the view illustrated in FIG. 1 but showing the valve assemblies in a different operational position.

The downhole tool assembly 24 and the overall tool string 26 comprise an interior passage 38 through which fluids may be flowed in either a downward direction or a reverse/upward direction. For example, well fluid may be allowed to flow along interior passage 38 during deployment of the tool string 26 downhole into wellbore 22. However, a variety of wellbore applications may utilize the flow of fluid along interior passage 38. Each ball 32 of the ball valve assemblies 28 also comprises an internal flow passage 40 to selectively enable flow along the interior passage 38 and through the ball valve assemblies 28, as illustrated in FIGS. 2 and 3.

In the embodiment illustrated in FIG. 1, the ball valves 30 of ball valve assemblies 28 have been rotated to a closed position which blocks flow of fluid along interior passage 38. However, the ball valve assemblies 28 are readily adjusted to other operational positions. In FIG. 2, for example, each ball valve 30 has been rotated to generally align the ball valve internal flow passage 40 with the interior passage 38 of tool assembly 24. Additionally, the internal one-way valves 34 have been oriented to allow fluid flow from right to left through the illustrated interior passage 38 while blocking flow in an opposite direction along interior passage 38. In FIG. 3, each ball valve 30 has been rotated approximately 180° to again generally align the ball valve internal flow passage 40 with the interior passage 38 of tool assembly 24. In this example, however, the internal one-way valves 34 have been oriented to allow fluid flow from left to right along the illustrated interior passage 38 while blocking flow in an opposite direction through interior passage 38. The rotation of ball valves 30 may be accomplished hydraulically, electrically, mechanically, manually, or by other suitable actuation methods. Depending on the specific design, the ball valves 30 may be rotated and set at a surface location and/or adjusted remotely while located downhole in wellbore 22.

Figure 3:
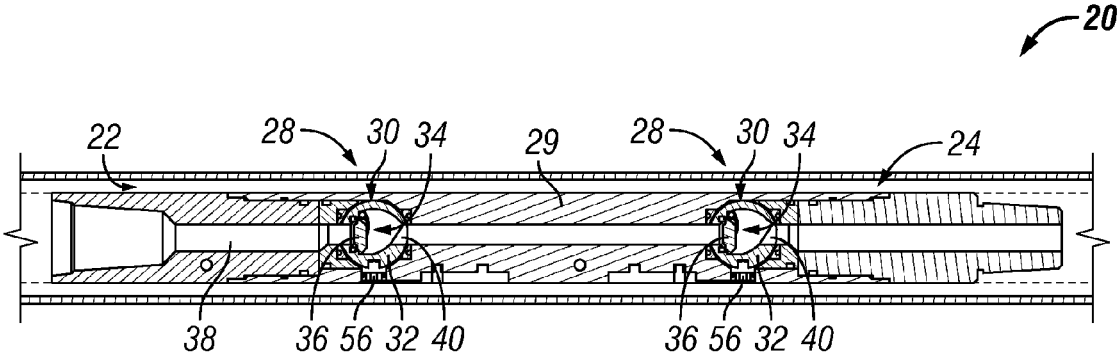
FIG. 3 is a cross-sectional view similar to the view illustrated in FIG. 1 but showing the valve assemblies in a different operational position.
Figure 4:
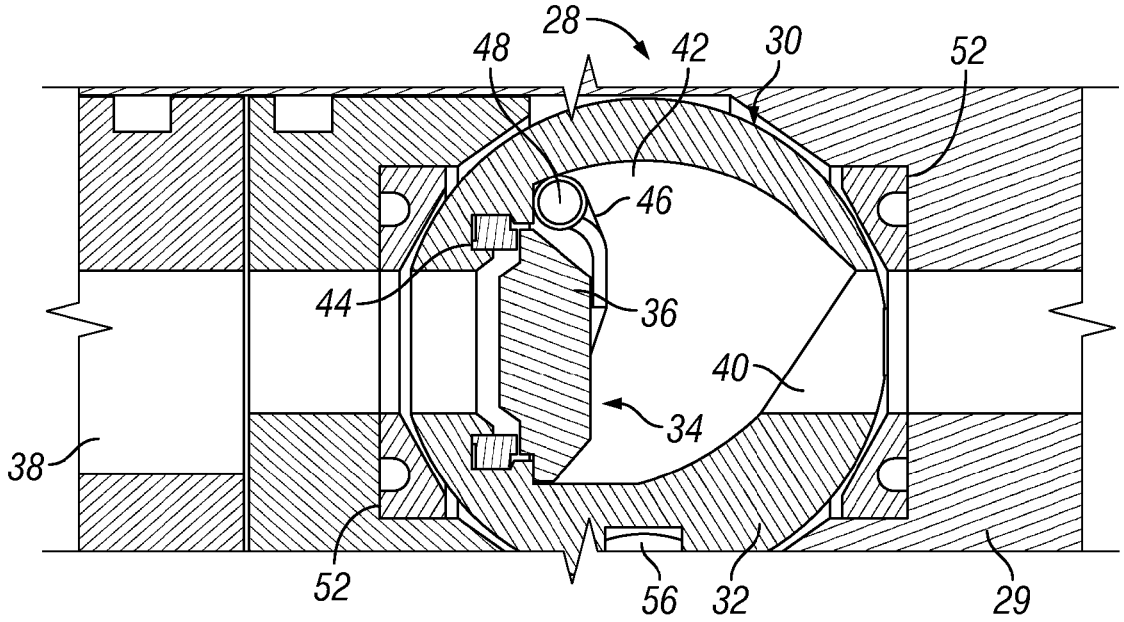
FIG. 4 is an enlarged cross-sectional view of one of the valve assemblies illustrating a rotatable element valve containing an internal one-way valve.

Referring generally to FIG. 4, an enlarged cross-sectional view of one of the ball valve assemblies illustrated in FIG. 3 is provided to facilitate an understanding of the functionality of the assembly. In this example, the ball valves 30 and one-way valves 34 may be combined with pressure test and pressure release features to facilitate pressure deployment jobs. In this specific example, each one-way valve 34 is a flapper valve having flapper 36 pivotably mounted within an interior 42 of the corresponding ball 32. The interior 42 may be designed with sufficient size to enable complete removal of the flapper 36 from the flow path through ball 32, thus providing full bore flow through the ball valve assembly 28 when the flapper 36 is pivoted to an open position.

Figure 5:
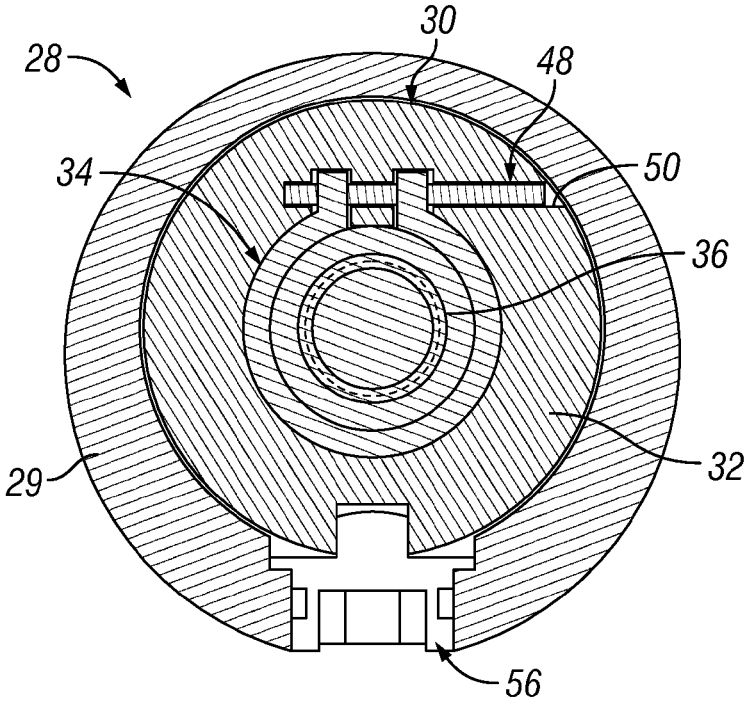
FIG. 5 is another cross-sectional view of one of the valve assemblies.

In many applications, the flapper 36 functions to isolate the upper and lower bore from pressure and provides positive sealing to prevent backflow from the well. As illustrated, a seal member 44 is mounted within the interior of ball 32 and provides a seat against which the flapper 36 closes to block flow along internal flow passage 40 and interior passage 38. The seal member 44 ensures against leaks once the flapper 36 is in a closed position. Additionally, a spring member 46 may be employed to bias the flapper 36 toward the closed position. As further illustrated in FIG. 5, the flapper 36 may be pivotably mounted about a pin 48 disposed within a pin passage 50 formed in ball 32. In one example, spring member 46 may have a coil portion disposed about pin 48. The pin passage 50 may be plugged following insertion of pin 48.

Figure 6:
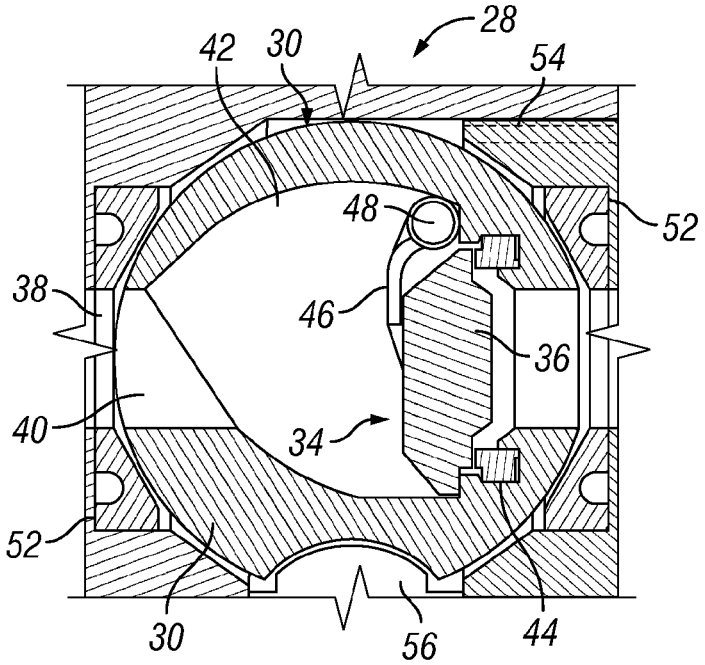
FIG. 6 is a cross-sectional view similar to FIG. 4 but showing the rotatable element valve and one-way valve positioned in a different operational orientation.

As discussed above, operation of the flapper 36 does not affect the flow characteristic through the ball valve assembly 28 because the flapper 36 may be pivoted to a fully retracted position within the interior 42 of ball 32. The fully retracted position provides a full bore passage for fluids flowing to, for example, other tools downhole. In this embodiment, the ball 32 performs as a cartridge and carrier for the flapper 36 and controls the direction/orientation of the flapper while also enabling complete blocking of the interior passage 38. Each ball 32 can be adjusted to a plurality of different positions. For example, each ball 32 may be adjusted to a flow down position, as illustrated in FIG. 4, a closed or flow blocking position, as illustrated in FIG. 1, and a reverse circulation position, as illustrated in FIG. 6. In the embodiment illustrated in FIG. 6, the ball 32 has been rotated 180° so that the flapper 36 is oriented to allow flow in an opposite, e.g. reverse, direction. The ball 32 may rotate on a suitable support member or members 52 to facilitate rotation of the ball valve 30 between its various positions. Members 52 also may comprise seal members to facilitate sealing of the ball 32 with respect to the surrounding housing. It should be noted that FIG. 4 illustrates one method of sealing on the ball 32, but other methods may be employed. For example, sealing systems may be employed in which the sealing force is controlled and/or limited by having a floating seat set up in which the pressure driving it onto the ball 32 is due to a sealing bore that is only slightly larger than the diameter of the sealing surface touching the ball 32.

One or more ports 54 may be routed to the ball 32 to enable delivery of desired materials to the ball valve. By way of example, the port or ports 54 may be used to deliver lubricant, e.g. grease, to the ball 32 to facilitate rotation of the ball. Additionally, one or more of the ports 54 may be used to inject sealing material in the event of valve failure.

Each ball valve 30 may be operated independently according to the requirements of a specific downhole job. For example, an upper ball valve 30 and the corresponding one-way valve 34 may be placed in a normal flow down position while a lower ball valve 30 and the corresponding one-way valve 34 can be placed in a reverse circulation position. This particular valve arrangement is useful for testing the pressure integrity of various tools. In one particular example, the pressure testing can be performed using a test port located between the ball valves 30.

Figure 7:
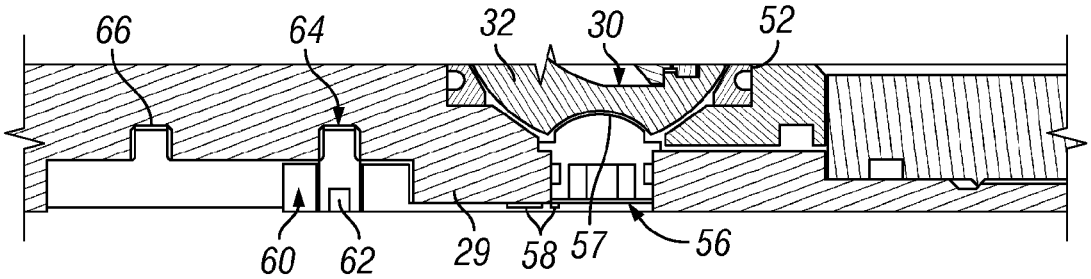
FIG. 7 is a cross-sectional view of a portion of the valve assembly illustrating a locking member for securing the rotatable element valve in a desired operational position.

According to one embodiment, each ball 32 may be selectively locked in a desired position once the deployment process is completed. In a typical application, the ball valves 30 would be locked in a pump down position, while the one-way valve 34, e.g. flapper 36, provides additional protection and increases confidence with respect to eliminating human errors and unintentional release of pressure during the deployment and un-deployment. In one particular example, ball 32 may be operated via a control key 56 engaged with a mating socket 57, as illustrated in FIG. 7. The control key 56 may be employed to adjust ball 32 with the help of a tool, e.g. a hex tool, designed to engage the control key 56. Furthermore, the control key 56 and mating socket 57 may be designed to engage in only one orientation to facilitate a visual display of the ball orientation using the key 56 and/or socket 57. Additionally or alternatively, markings or other suitable indicators 58 may be located on control key 56 and/or housing 29 to indicate the position of control key 56 and ball 32. For example, the orientation of the balls 32 may be marked in degrees both on the control key 56 and on the housing 29 surrounding control key 56.

The control key 56 may be secured, and thus the position of ball 32 may be secured, via a locking member 60, such as a locking sleeve designed to engage control key 56. In some embodiments, the control key 56 may be designed to engage a corresponding socket of locking member 60 only when the ball 32 of ball valve 30 is in a specific orientation. Locking member 60 effectively locks the ball 32 in a desired position during a given well related job to prevent the accidental or undesirable operation of tool assembly 24.

The locking member 60, e.g. locking sleeve, may be secured to the housing 29. For example, a screw 62 or other suitable fastener may be used to secure the locking member 60 at a desired position. In some applications, the locking member 60 is designed for movement between two positions in which the ball 32 is either locked or allowed to rotate. In the free rotation position, the locking member 60 may be pulled back, disengaged from control key 56, and secured in this position with fastener 62. For example, securing of the locking member 60 at a first position 64 can be used to lock control key 56 and ball 32, while securing of the locking member 60 at a second position 66 can be used to allow free rotation of ball 32. Color coding may be incorporated into the locking member 60 and/or control key 56 to help ensure the balls 32 are in a desired position, e.g. in the correct position for deployment. For example, the locking member 60 may uncover a contrasting area of color when unlocked.

The design of tool assembly 24 and its ball valve assemblies 28 also facilitate testing of the ball valves 30. For example, the design enables testing to positively identify whether the balls 32 and/or one-way valves 34 are functioning properly or leaking. The design also provides the ability to test the pressure below or above each ball valve 30 and below or above the tool assembly. Pressure testing may be accomplished by utilizing a plurality of pressure test access ports 68, e.g. two or three sets of pressure test access ports 68 and 68*a*, as illustrated in FIGS. 8-11. By way of example, one of the ports 68 or 68*a* may be installed above or on top of the upper ball valve assembly 28 and a second of the ports 68 or 68*a* may be installed between the ball valve assemblies 28. However, the pressure access ports 68 or 68*a* may be located above, below, and/or between the ball valves 30.

Figure 8:
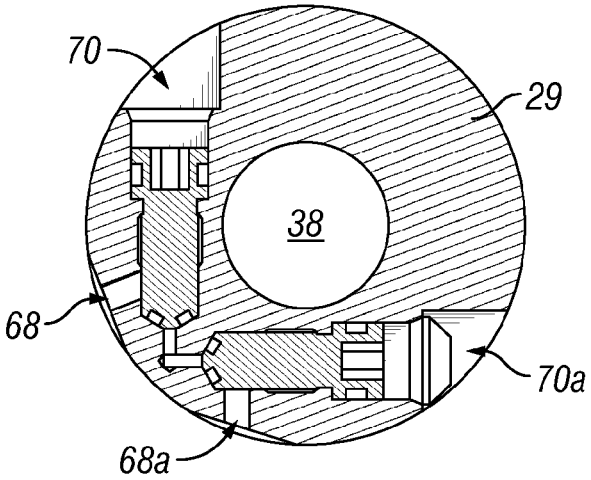
FIG. 8 is a cross-sectional view of a portion of the tool string assembly illustrating ports which may be used for pressure testing.

Each test port 68 or 68*a* may work in cooperation with a pair of valves 70 or 70*a*, as best illustrated in FIG. 8. One of the valves 70 or 70*a* may be used to isolate the port 68 or 68*a* during operations, while the second valve 70 or 70*a* may be used either to bleed off pressure through another port 68 or 68*a* or to enable installation of a pressure gauge. Pressure gauges can be used to monitor pressure in specific ports and to indicate to an operator whether the ball valves 30 remain in good condition. The use of two valves 70 and 70*a* provides redundancy, and the valves can be backed out to an installed safety snap ring. By way of example, each valve 70 and 70*a* may be of a double seal type with an operating seal and a stem seal. Alternatively, one valve of the pair of valves 70 or 70*a* may comprise or be replaced with a simple plug. The plug 70 or 70*a*, in turn, can be replaced with a gauge and/or a test system. Additionally, each external port 68 or 68*a* may be prepared for the sealed attachment of a gauge and/or test system. The test port 68*a* may be set up with two or more seals between the interior passage 38 and the system exterior, and the seals may be tested during the process of closing or opening the port. For example, the bottom port 68*a* illustrated in FIG. 8 may initially be closed while pressure is pumped against it through the left hand port 68 to check whether the port is sealed. Additionally, in at least some applications the bottom port 68*a* is plugged permanently with an appropriate plug or other type of closure member.

Figure 9:
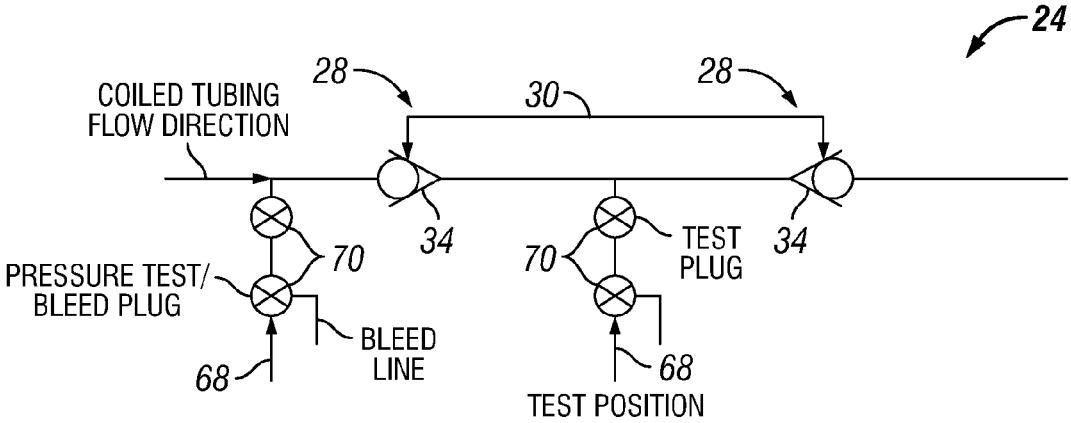
FIG. 9 is a schematic illustration representing the valve assemblies oriented in a test position for pressure testing the tool string assembly.
Figure 10:
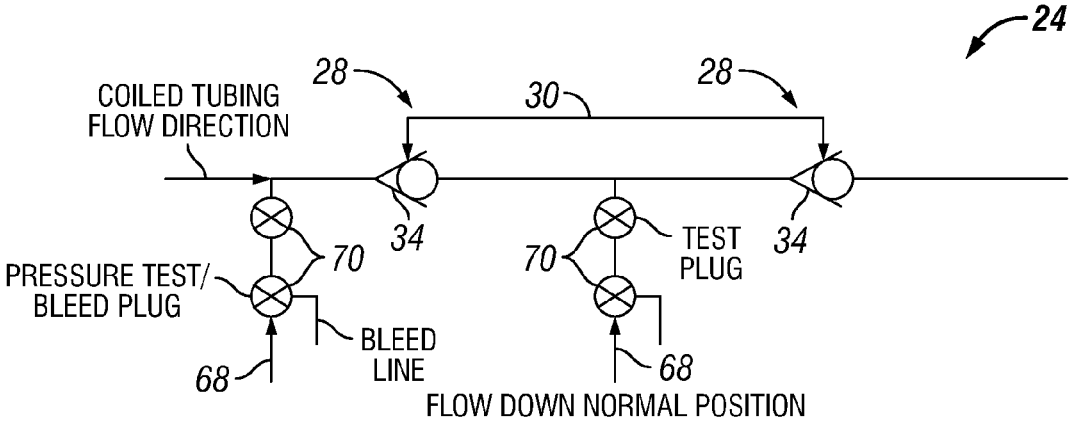
FIG. 10 is a schematic illustration representing the valve assemblies oriented in a flow down normal position.
Figure 11:
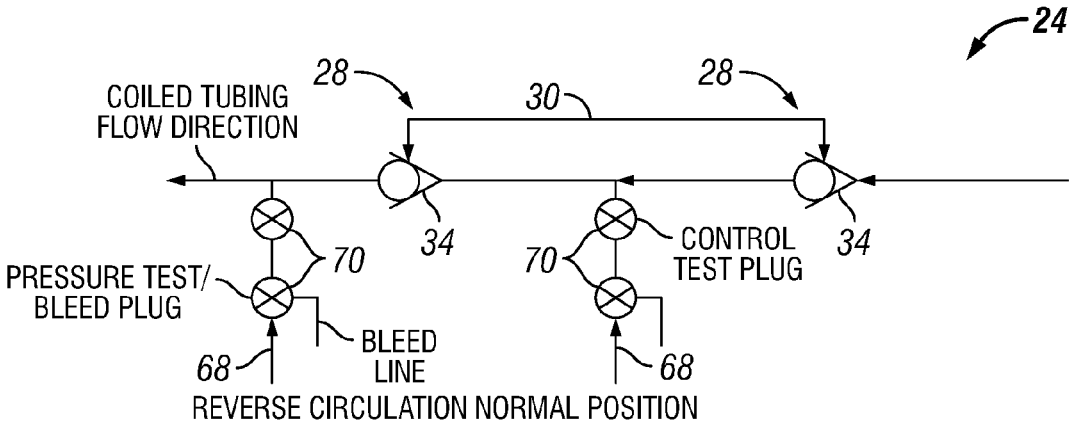
FIG. 11 is a schematic illustration representing the valve assemblies oriented in a reverse circulation normal position.

As illustrated in FIGS. 9-11, the valve assemblies 28 may be arranged in a variety of configurations to facilitate testing and/or fluid flow for a given downhole application. In FIG. 9, for example, the ball valves 30 and the one-way valves 34 are arranged in opposing orientations to facilitate testing by blocking flow through the one-way valves, e.g. flapper valves, in two opposed directions. However, both valve positions illustrated in FIG. 9 can be reversed to provide a test position with both check valves set to allow flow into the center cavity. This allows verification that both one-way valves 34 and both ball valves 30 are holding pressure. Additionally, the ball valves 30 and the corresponding one-way valves 34 may be oriented to allow flow through both ball valve assemblies 28 in the same direction while preventing flow through both ball valve assemblies 28 in the opposite direction, as illustrated in FIG. 10. In FIG. 10, the valve assemblies 28 are arranged in a flow down normal position.

Similarly, the ball valves 30 and the corresponding one-way valves 34 may be reversed to allow flow through both ball valve assemblies 28 in the same direction while preventing flow through both ball valve assemblies 28 in the opposite direction, as illustrated in FIG. 11. In FIG. 11, the valve assemblies 28 are arranged in a reverse circulation normal position. Accordingly, the ball valve assemblies 28 may be adjusted to a variety of configurations to facilitate operational fluid flow and/or testing. Additionally, the arrangement of pressure test ports 68, 68*a* and corresponding valves/plugs 70, 70*a* facilitate application of a variety of pressure tests on ball valve assemblies 28 and the overall tool assembly 24.

The ports 68 and 68*a* and valves 70 and 70*a* may be used in cooperation with ball valves 30 and one-way check valves 34 to perform a variety of functions. For example, the ports 68 or 68*a* may be used to release energized fluid, e.g. liquid or gas, above and/or below specific valve assemblies 28 to an external containment. A suitable pipe or hose line can be attached to the ports 68 or 68*a* when the fluid has been purged to a suitable environment, e.g. the surrounding air. Similarly, the port 68 or 68*a* may be used for attaching pressure gauges which allow pressures to be read and/or monitored at any of the valve positions of valve assemblies 28. The ports 68 and 68*a* also enable manipulation of pressure across the ball valves 30 by, for example, equalizing or increasing the pressure. This enables control over downhole tools by providing a pressure source and/or by preventing premature activation of the downhole tools.

Use of the rotatable element valve assemblies 28 further enables testing of a variety of tools while they are attached to the tool string 26. By way of example, the ability to control valve assemblies 28 enables testing of quick test stab or quick latch tools while there attached to the tool string. Examples of such tools include the Schlumberger N+1 connector and NOV Carsac tools available from Schlumberger Corporation. At the surface or during deployment, the valve assemblies further provide the option of blocking gases or other fluids from escaping out of the coiled tubing or drill pipe of certain embodiments of tool string 26. Unlike current systems which allow the fluid/gas to drip out, the valve assemblies 28 are readily controlled to prevent the undesirable loss of these fluids while at the surface or during deployment.

Figure 12:
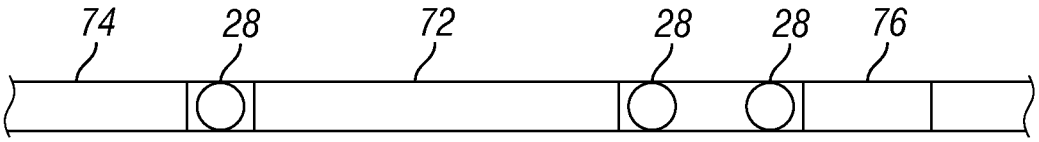
FIG. 12 is a schematic illustration representing an example of a tool string arrangement utilizing a connector located between rotatable element assemblies.
Figure 13:
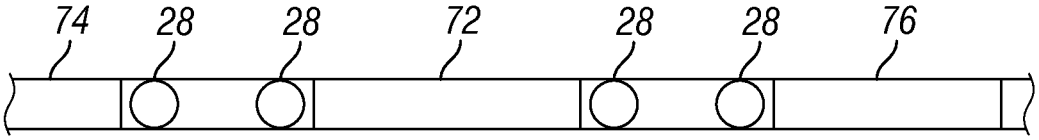
FIG. 13 is a schematic illustration representing another tool string arrangement utilizing a connector located between rotatable element assemblies.

The ball valve assemblies 28 may be employed in a variety of tool strings 26 to facilitate many types of fluid flow control operations. In some applications, a connector 72 is placed between valve assemblies 28 so that the connector 72 can be tested independently of a coiled tubing string 74, as illustrated schematically in FIGS. 12 and 13. In FIG. 12, for example, the system comprises connector 72 separated from coiled tubing 74 by a rotatable element valve assembly 28. On an opposite end of the connector 72, the connector 72 is separated from a downhole tool 76 by a pair of valve assemblies 28. The alternate embodiment illustrated in FIG. 13 is similar to the embodiment illustrated in FIG. 12 except for the plurality of valve assemblies 28, e.g. two valve assemblies, positioned between connector 72 and coiled tubing 74. Having two or more valve assemblies 28 provides redundant pressure barriers between the well and the surface during operational procedures, such as deployment.

Depending on the specific well related application, the number and arrangement of ball valve assemblies 28 may be adjusted. However, combining the functionality of the ball valve and the one-way valve, e.g. flapper valve, reduces the length of the overall tool assembly and facilitates a variety of testing procedures. The specific types of valves selected can vary for different types of applications. For example, dart type valves can be installed within the balls 32. Similarly, flow control or pressure control valves may be located in the ball valves 30 in addition to or in lieu of the flapper valves. Furthermore, the tool assembly 24 and the other tools utilized above or below tool assembly 24 may vary depending on the specific type of well operation to be conducted. Similarly, the specific configurations of the ball valves, flapper valves, locking mechanisms, and other components described herein may be changed to accommodate the parameters of a given application.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of facilitating delivery of a tool assembly downhole, comprising:

positioning a rotatable element valve within a tool string at a location, placing a one-way valve within the rotatable element valve, positioning a second rotatable element valve in the tool string; and placing a second one-way valve in the second rotatable element valve;

the rotatable element valve and the one-way valve movable between a first position allowing fluid flow along an internal passage of the tool string only in a first direction and a second position allowing fluid flow along the internal passage of the tool string only in a second direction;

providing the rotatable element valve with a port for pressure testing; and pressure testing the tool string at least one of above, below and between the first and second rotatable element valves, the pressure testing providing an indication to an operator whether the rotatable element valves remain in good condition for subsequent deployment downhole.

2. The method as recited in claim 1, further comprising delivering the tool string downhole into a wellbore subsequent to pressure testing the tool string.

3. The method as recited in claim 1, further comprising utilizing the first and second rotatable element valves to test quick test stab or quick latch type tools while they are attached to the tool string.

4. The method as recited in claim 1, further comprising utilizing the first and second rotatable element valves to block fluid from escaping out of the tool string while at the surface or during deployment.

5. The method as recited in claim 1, further comprising providing adjustability of the first and second rotatable element valves between a flow down position, a flow block position, and a reverse circulation position.

6. The method as recited in claim 1, further comprising locking the rotatable element valve in an open position to accommodate full bore flow along the internal passage.

7. The method as recited in claim 1, further comprising providing an indicator on an exterior of the tool string to indicate the operational position of the rotatable element valve.

8. The method as recited in claim 1, further comprising pumping a lubricating material through the port.

9. The method as recited in claim 1, further comprising injecting a sealing material through the port in the event of valve failure.

10. The method as recited in claim 1, further comprising using the port to release energized fluid to an external containment and attaching a flow line to the port.

11. The method as recited in claim 1, further comprising using the port to manipulate pressure across the rotatable element valve for exercising control over a downhole tool.

12. A downhole system, comprising:

a tool string section having an internal flow passage;

a plurality of ball valves positioned in the tool string section, each ball valve having a ball which is adjustable to control flow along the internal flow passage in an uphole direction in a first position and a downhole direction in a second position; and a plurality of one-way valves positioned in an interior of each ball of the plurality of ball valves and configured to block flow in either an uphole direction or a downhole direction depending on the adjusted position of the ball valve, wherein the tool string section comprises a plurality of ports for pressure testing the plurality of ball valves and for attachment of pressure gauges for reading the pressure in any of the valve positions and for testing the pressure integrity of the tool string.

13. The downhole system as recited in claim 12, wherein each one-way valve comprises a flapper and each ball comprises an interior seal against which the flapper is seated when in a closed position.

14. A method of deploying a tool into a wellbore, comprising:

positioning a pair of sequential rotatable element valves in a tool string having an internal flow passage, each of the rotatable element valves rotatable between a first position and a second position;

locating a pair of one-way valves in the pair of sequential rotatable element valves, each one-way valve operating within a rotatable element of a corresponding rotatable element valve of the pair of sequential rotatable element valves and configured to block flow through the tool string in either an uphole direction or a downhole direction depending on the position of the rotatable valves;

arranging the rotatable element valves and the one-way valves in a configuration for a given downhole application;

pressure testing each of the valves in the configuration via at least one pressure test access port for each of the pair of valves, the pressure testing verifying the rotating element valves and the one-way valves are holding pressure; and delivering the tool string downhole into a wellbore after pressure testing the valves.

15. The method as recited in claim 14, further comprising locking each rotatable elements valve at a desired operational position with a locking member.

16. The method as recited in claim 14, further comprising operating the pair of sequential rotatable element valves manually, electrically, or hydraulically.

17. The method as recited in claim 14, wherein pressure testing comprises adjusting the valves to test the valves in a variety of configurations.

18. The method as recited in claim 17, wherein at least one configuration comprises verifying the valves are holding pressure.

* * * * *